US010054281B2

(12) United States Patent
Hoffmann

(10) Patent No.: US 10,054,281 B2
(45) Date of Patent: Aug. 21, 2018

(54) LIGHTING APPARATUS

(71) Applicant: HELLA KGaA Hueck & Co., Lippstadt (DE)

(72) Inventor: Ingo Hoffmann, Berlin (DE)

(73) Assignee: HELLA KGAA HUECK & CO., Lippstadt (DE)

( * ) Notice: Subject to any disclaimer, the term of this patent is extended or adjusted under 35 U.S.C. 154(b) by 149 days.

(21) Appl. No.: 15/061,042

(22) Filed: Mar. 4, 2016

(65) Prior Publication Data

US 2016/0258590 A1 Sep. 8, 2016

(30) Foreign Application Priority Data

Mar. 4, 2015 (DE) ..... 10 2015 203 887

(51) Int. Cl.
*F21V 1/00* (2006.01)
*F21S 8/10* (2006.01)

(52) U.S. Cl.
CPC ..... *F21S 48/1715* (2013.01); *F21S 48/1225* (2013.01); *F21S 48/1747* (2013.01)

(58) Field of Classification Search
USPC ..... 362/509
See application file for complete search history.

(56) References Cited

U.S. PATENT DOCUMENTS 7,131,759 B2 * 11/2006 Ishida ..... F21S 48/1154 257/E33.072
2014/0177253 A1 6/2014 Weissenberger et al.

FOREIGN PATENT DOCUMENTS

| | | | |
|---|---|---|---|
| DE | 100 05 795 | A1 | 8/2001 |
| DE | 103 21 564 | A1 | 12/2004 |
| DE | 10 2005 014 953 | A1 | 10/2006 |
| DE | 10 2008 011 699 | A1 | 9/2008 |
| DE | 10 2007 063 183 | A1 | 6/2009 |
| DE | 10 2011 109 434 | A1 | 6/2012 |
| DE | 10 2012 224 345 | A1 | 6/2014 |
| EP | 2 529 975 | A2 | 12/2012 |
| FR | 2 996 629 | A1 | 4/2014 |

OTHER PUBLICATIONS

German Search Report, Application No. DE 10 2015 203 887.4, dated Nov. 17, 2015, 7 pgs.

* cited by examiner

*Primary Examiner* — Jamara Franklin
(74) *Attorney, Agent, or Firm* — Paul D. Strain, Esq.; Strain & Strain PLLC

(57) ABSTRACT

The invention relates to a lighting apparatus, particularly for a motor vehicle, having a plurality of illuminants as light sources that each produce an individual light distribution, having means for setting the direction of radiation of the individual light distribution of the illuminants and having means for setting the focusing of the individual light distribution of the illuminants and having control means for controlling the settings of the individual light distributions to produce a superimposed overall light distribution by dint of superimposition of the individual light distributions of at least single illuminants.

22 Claims, 13 Drawing Sheets

LIGHTING APPARATUS

CROSS-REFERENCE TO RELATED PATENT APPLICATIONS

This application is based upon and claims the benefit of priority from prior German Patent Application No. 10 2015 203 887.4, filed Mar. 4, 2015, the entire contents of which are incorporated herein by reference in their entirety.

TECHNICAL FIELD

The invention relates to a lighting apparatus, particularly for a motor vehicle. The invention also relates to a method for controlling a lighting apparatus.

PRIOR ART

Lighting apparatuses have become known as headlamps for motor vehicles, for example, which are arranged on the front of a vehicle and can produce different lighting variants. Thus, headlamps can produce a parking light, a low beam or a high beam, which is used to light the region or the roadway in front of the motor vehicle.

In this case, headlamps each having a fixed illuminant as light source for the respective light are known. These headlamps are not adjustable to the respective traffic situation. Headlamps having a swivelable illuminant or having an associated optical system have also become known that are swivelable as cornering lights for cornering, for example. In this case, the light intensity of the respective illuminant is not adjustable to suit the traffic situation, however.

Furthermore, headlamps having an adaptive bright/dark boundary have become known. In this case, the light distributions are produced by resorting to data from the vehicle surroundings. A camera detects oncoming vehicles and vehicles ahead. For example a stepping motor is used to rotate a cylinder, for example in what is known as a VarioX module, into the required position within a few milliseconds. This has the advantage that it allows the beam of light to end directly in front of the oncoming vehicles or behind the vehicles ahead.

Furthermore, a dazzle-free full beam has become known. In this case, the automobile driver drives on full beam continuously. When the camera detects other road users, they are cut out of the full beam distribution, for example in the form of a tunnel, using vertical bright/dark boundaries. The number of tunnels is limited in this case, however, on the basis of the design.

In addition, LED matrix headlamps have become known, in which a matrix of controlled-intensity LED elements is provided, with individual fixed matrix elements being disconnectable or connectable in order to produce the parking light, the low beam, the daytime running light, the high beam and/or multiple horizontal and/or vertical bright/dark boundaries, particularly to form tunnels. In this case, the emitted light is adjusted to suit the respective traffic situation only to a limited extent, however, by dint of LED matrix elements being disconnected and connected. The number of tunnels that can be produced is dependent on the number of LED elements provided. As a result, the emitted light is variable only to a limited extent. In this case, the LED elements each light solid angle ranges of their own without overlap or with only slight overlap. In order to be able to produce a largely homogeneous light distribution and a required number of bright/dark boundaries, there is furthermore a need for a large number of LED elements, which results in a high level of production complexity and in high susceptibility to error. Furthermore, cornering lights may require further light sources to be arranged in the lateral regions of the vehicle.

LCD matrix headlamps have also become known, in which LCD elements are used to produce backlighting, this backlighting needing to be suitably attenuated in order to obtain a desired light distribution. This means that power in the order of magnitude of 70% or more needs to be eliminated because, of the 100% of the amount of light produced, approximately 70% needs to be eliminated again in order to achieve the desired light distribution.

The trend is therefore moving toward more automation and toward better lighting of the region or of the roadway in front of the motor vehicle, because this achieves improved comfort and an increase in safety. Lighting adjusted to suit traffic conditions can also be used to achieve improved energy efficiency.

PRESENTATION OF THE INVENTION, PROBLEM, SOLUTION AND ADVANTAGES

It is therefore the object of the invention to provide a lighting apparatus which is of simple design and nevertheless permits high variability with respect to the emitted light. It is also the object of the invention to provide a method for controlling a lighting apparatus that is used to control a lighting apparatus in order to be able to cope with variable traffic situations. In addition, it is the object to provide a control apparatus that can be used to perform a method for actuating a lighting apparatus.

The object according to the invention in relation to the lighting apparatus is achieved by means of the features of claim 1.

An exemplary embodiment of the invention relates to a lighting apparatus, particularly for a motor vehicle, having a plurality of illuminants as light sources that each produce an individual light distribution, having means for setting the direction of radiation of the individual light distribution of the illuminants and having means for setting the focusing of the individual light distribution of the illuminants and having control means for controlling the settings of the individual light distributions to produce a superimposed overall light distribution by dint of superimposition of the individual light distributions of at least single illuminants. As a result, superimposition of the individual light distributions, which are each dynamically controllable, produces a dynamically controllable fully adaptive light distribution. This allows the production of more bright/dark boundaries with fewer illuminants without great power losses. In addition, it is also possible to produce a homogeneous light distribution. Since the respective light distributions have a swivellable direction of radiation, it is also advantageously possible to make use of the fact that failure of or damage to one illuminant prompts another illuminant to undertake the task of the damaged illuminant. This achieves improved redundancy and a longer life.

The lighting apparatus according to the invention can be used as a headlamp or as a lateral and/or rear lighting apparatus and/or possibly even as a tail light, depending on the field of application. This lateral and/or rear lighting apparatus can produce a light distribution for reversing, in curves or even continuously.

It is particularly advantageous if the illuminants are in a form such that the intensity of the individual light distribution is adjustable, the respective intensity of the individual light distribution of the illuminants being controllable by the control means. Thus, besides the direction of radiation and the focusing, which is defined as the width of the light distribution in a lateral direction, it is also possible to control the intensity of the light distribution as required. As a result, it is possible for a change in the intensity in the light distribution to be made independently of the number of superimposed individual light distributions. This results in greater dynamics and broader applicability for the lighting apparatus.

It is also advantageous if the direction of radiation, the focusing and/or the intensity of the light distribution of the respective illuminant is or are individually adjustable. As a result, it is possible to produce a highly dynamically adjustable overall light distribution that complies with the respective traffic situation, depending on traffic situation and requirements.

In this case, it is particularly advantageous if the overall light distribution has an actuatable angle-dependent intensity profile and/or an actuatable angle-dependent intensity gradient profile. This is achieved by dint of suitable control of the respective individual light distributions and the superimposition thereof. As a result, it is possible to produce a defined illumination and/or, by way of example, a defined bright/dark profile.

In this case, it is advantageous if a defined bright/dark profile is produced by superimposing three or more individual light distributions. In particular, vertical bright/dark boundaries and/or horizontal bright/dark boundaries can be produced and optionally also adapted. This can be used to not light road users at risk of dazzling or to light them only at lower intensity. In addition, regions with reflecting elements can be lit less powerfully in order to prevent self-dazzling. Furthermore, it is optionally also possible to light regions, particularly hazard regions, in a particularly intensive manner in order to divert attention thereto.

There is furthermore particular advantage in the shaping of a model-specific appearance and handling, also called "look and feel", which can manifest itself in the nature of the adjustment of the light distributions for example.

In one advantageous exemplary embodiment, it is expedient if the adjustment of the overall light distribution is controlled by dint of activation of the individual light distributions in time steps. It is thus possible for the individual light distributions to be respectively selected and set in successive time steps.

In this case, the direction of radiation of the individual light distribution can be adjusted from an initial direction of radiation by an essentially arbitrary adjustable angle. This angle may be limited on the basis of direction if need be but depending on the design.

It is also advantageous if the direction of radiation at the individual light distribution is set by dint of adjustment of the lighting direction in respect of two angles that are measured relative to two planes that are preferably arranged at right angles to one another. Particularly advantageously, the two angles are a pitch angle and/or a yaw angle relative to an initial direction of radiation from the individual light source, relative to the vehicle coordinate system or relative to any other coordinate system.

It is also expedient if the focusing of the individual light distribution is set by dint of adjustment of the width of the light distribution in the horizontal direction and/or in the vertical direction or in two other directions that are perpendicular to one another, for example.

According to a further aspect of the invention, it is expedient if the image sharpness is adjusted in horizontal and vertical directions together, so that a circular light distribution structure results or is provided separately, so that an elliptical light distribution structure results.

In this case, it is advantageous if the elliptical light distribution structure may be additionally twisted so that an elliptical light distribution structure that is not axially parallel results.

In this case, it is advantageous if the adjustment is made in a positive vertical and/or horizontal direction and/or in a negative vertical and/or horizontal direction independently, so that a light distribution structure that possibly has a different expansion in the four directions results.

In addition, it is advantageous if the image sharpness is adjusted differently in more than four directions, so that an arbitrarily shaped light distribution structure results.

It is also advantageous if the overall light distribution results from superimposition of the individually adjustable individual light distributions from the illuminants, which are essentially all actuatable individually or at least to some extent in groups.

It is particularly advantageous if the overall light distribution results from superimposition of the individually adjustable individual light distributions of the illuminants, with a static basic light distribution being provided by at least one illuminant and being combinable with dynamically controllable individual light distributions of other illuminants. As a result, it is possible to produce a basic light distribution that can be changed statically or at least not highly dynamically, so that the highly dynamic changes in the overall light distribution can be achieved by other illuminants.

In this case, it is particularly advantageous if the static basic light distribution and the individual light distributions are split over different solid angles. As a result, the effect that can be achieved is that the light of the basic light distribution extends to a region in space or a solid angle range into which the other illuminants essentially do not shine.

In the case of a further exemplary embodiment, it is also advantageous if the static basic light distribution and the individual light distributions are combined at least to some extent at the same solid angles. It is thus advantageous if the static basic light distribution overlaps and is superimposed in the same regions. This has the advantage that the basic light distribution prompts basic illumination that is superimposed by the dynamically controllable basic light distributions of other illuminants.

In this case, it is particularly advantageous if the number of illuminants provided is in the range from approximately 10 to 100 illuminants, preferably is approximately 15 to 50 illuminants. This allows the number of illuminants to be kept small, and it is nevertheless possible to achieve dynamic adjustment of the overall light distribution to suit the traffic situation.

It is also expedient if the luminous element has an associated reflector and/or an associated projection optical system, the reflector and/or the projection optical system being adjustable relative to the luminous element, and/or the luminous element also being adjustable. This allows the implementation of mechanical or electromechanical setability or adjustability.

It is also advantageous if the luminous element is adjustable particularly together with the reflector and/or with the projection optical system.

In this case, it is particularly advantageous if the adjustability also comprises a swivellability. As a result, the luminous element and if need be also the projection optical system and/or the reflector can be swiveled as well, which means adjustment to the direction of radiation.

In addition, it is advantageous if the adjustability also comprises adjustment of the distance of the luminous element from the projection optical system, so that alteration of the image sharpness can be achieved. In this case, the width can increase, such as concavely or biconcavely, or decrease, such as convexly or biconcavely, on the basis of the predefined direction of the surface curvature at a greater distance.

In one alternative exemplary embodiment, it is also advantageous if the luminous element has an associated electrically or electronically controllable liquid lens arrangement that can be used to select the direction of radiation of the individual light distribution of the illuminant and/or the focusing of the individual light distribution of the illuminant. The provision of such a liquid lens arrangement is particularly expedient because simple electrical or electronically controlled selection can be used to effect both the direction of radiation and, when required, also the focusing. Such liquid lens arrangements are also simple to manufacture and simple to install.

It is also advantageous if the liquid lens arrangement has an arrangement of two fluids that are arranged adjacently in an axial direction, are separated by a flexible wall and are arranged in an annular housing, the relative shaping of said fluids being alterable by means of electrical actuation. It is thus possible to dynamically alter the focal length and the design of the two lenses as convex or concave lenses. This can also change in modulating fashion over the perimeter, for example in order to alter or set the direction of radiation.

In this case, it is particularly advantageous if the annular housing has electrodes provided on it for controlling the shaping. This allows a good level of actuatability in a small required installation space.

It is also advantageous if the luminous element and the liquid lens arrangement have a primary optical system arranged between them for influencing the light distribution produced by the luminous element. In this case, the primary optical system may be an optical apparatus that produces the fundamental elementary light distribution, which may be in the shape of a Gaussian curve, rectangular, etc., for example, and which is then altered further by means of the liquid lens arrangement.

In this case, it is also particularly advantageous if a matrix of luminous elements with a respective associated primary optical system and a liquid lens arrangement is provided. As a result, specific actuation of the respective illuminants and/or of the liquid lens arrangement can produce a dynamic overall light distribution.

An exemplary embodiment relates to a method for controlling a lighting apparatus, particularly a lighting apparatus as described above, wherein the individual light distribution of the respective luminous elements is dynamically selectable using their associated optical elements, in order to achieve a dynamically controllable overall light distribution. In this case, the optical elements are a reflector, a projection optical system, a primary optical system and/or a liquid lens arrangement, for example.

It is particularly advantageous if a dynamically selectable overall light distribution is produced by taking dynamic selection of individual light distributions of luminous elements as a basis for actuating means to set the direction of radiation of the individual light distribution over the illuminants and/or for actuating means to set the focusing of the individual light distribution of the illuminants.

It is particularly advantageous if the overall light distribution is produced by selecting the intensity of the individual light distribution. It is also expedient if the means for setting the direction of radiation of the individual light distribution of the illuminants and/or the means for setting the focusing of the individual light distribution of the illuminants are in the form of a liquid lens arrangement, with a primary optical system being provided between the illuminant and the liquid lens arrangement if need be.

The invention also relates to a control apparatus for performing a method according to the invention for actuating a lighting apparatus according to the invention.

Further advantageous embodiments are described by the description of the figures that follows and by the subclaims.

BRIEF DESCRIPTION OF THE DRAWINGS

The invention is explained in more detail below on the basis of at least one exemplary embodiment with reference to the figures of the drawing, in which.

PREFERRED EMBODIMENT OF THE INVENTION

Figure 1:
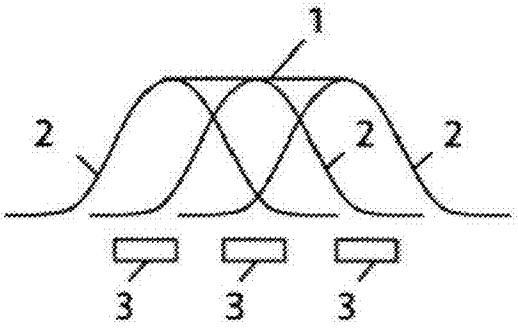
FIG. 1 shows a schematic illustration of an example of an overall light distribution.

FIG. 1 shows a two-dimensional view of an overall light distribution 1 that is obtained from three individual light distributions from two single illuminants 3. In this case, the intensity profile the individual light distributions 2 from the illuminants 3 is in the form of a Gaussian curve by way of example, so that the superimposition of the individual light distributions 2 results in an overall light distribution 1 that is flat in the central region.

Figure 2:
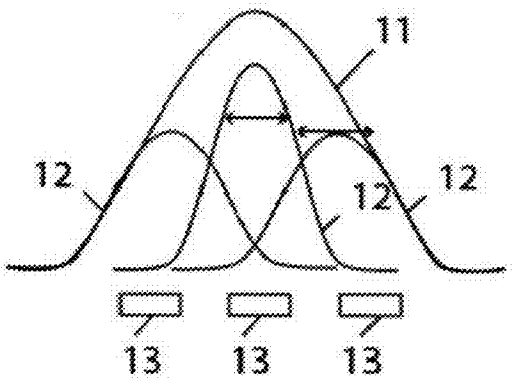
FIG. 2 shows a schematic illustration of a further example of an overall light distribution.

FIG. 2 shows a further example of an overall light distribution 11 in a two-dimensional illustration, in which the overall light distribution 11 is produced by three individual light distributions 12. The individual light distributions result from the illuminants 13. The individual light distributions 12 are set such that the two outer individual light distributions have a lower intensity but broader focusing than the central individual light distribution 12, which exhibits a higher intensity but narrower focusing. This results in an essentially Gaussian overall light distribution.

Figure 3:
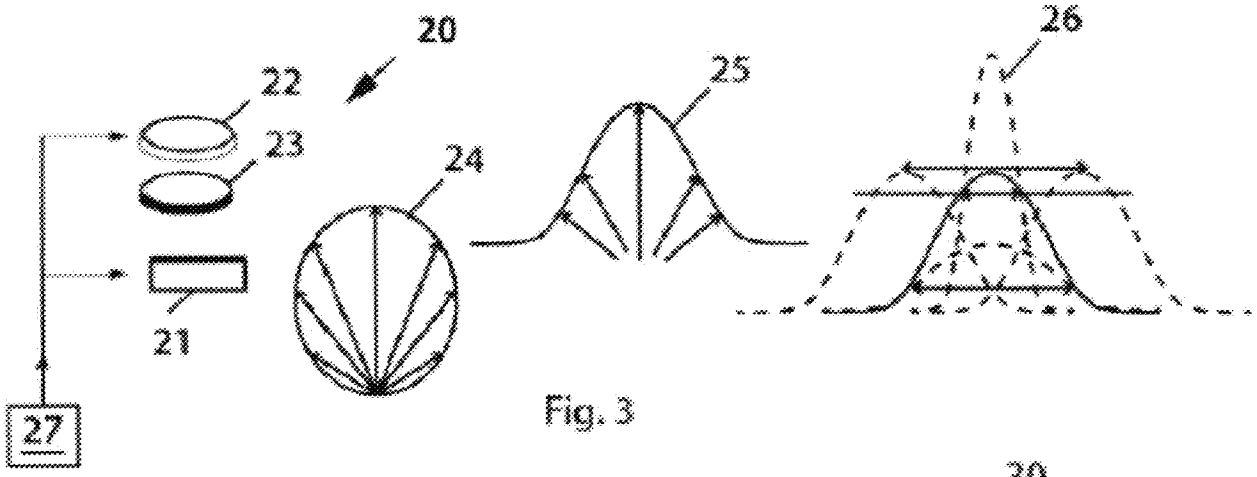
FIG. 3 shows a schematic illustration of an example of a lighting apparatus.

The left-hand part of the image in FIG. 3 shows an arrangement for a lighting apparatus 20 having an illuminant 21 and having means for setting the direction of radiation of the individual light distribution from the illuminant 21 and having means for setting the focusing of the individual light distribution from the illuminant 21, the means for setting the direction of radiation and the means for setting the focusing being formed by a liquid lens element 22 that forms the means for setting the direction of radiation and the means for setting the focusing. Provided between the liquid lens element 22 and the illuminant 21 is a primary optical element 23 that is used to take the general light distribution 24 from the illuminant 21 and produce an adjusted light distribution 25 that is then set by the liquid lens element 22 to produce a scalable individual light distribution 26. In this case, the adjusted light distribution 25 can correspond to a Gaussian curve, for example, but other distributions are likewise possible. In this case, the liquid lens element 22 and the illuminant 21 are preferably actuatable by a control means 27 in order to be able to set the intensity of the individual light distribution and/or to be able to set the direction of radiation of the individual light distribution and/or to be able to select the focusing of the individual light distribution.

Figure 4:
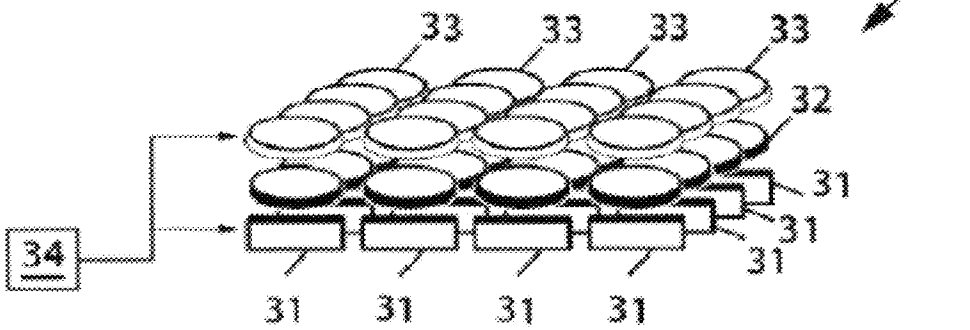
FIG. 4 shows a schematic illustration of a further example of a lighting apparatus.

FIG. 4 shows a lighting apparatus 30 according to the invention that has a multiplicity of illuminants 31 arranged in rows and columns. In this case, the illuminants 31 are arranged as a matrix, a 4×4 arrangement having been chosen in the exemplary embodiment shown. Alternatively, it is also possible for a different arrangement to be provided, as is also shown in the figures that follow, for example. In addition, it may correspond to a linear arrangement or to a matrix arrangement provided with gaps, and also to a different pattern. The illuminants 31 each have an associated primary optical system 32 and an associated liquid lens arrangement 33. The illuminants 31 and the liquid lens arrangements are preferably actuatable via the control means 34.

A lighting apparatus 30 as shown in FIG. 4 can perform selection of the individual light distributions of the illuminants 31 in accordance with the situation and/or traffic to produce a resultant overall light distribution that is dynamically selectable in accordance with the ambient situation, the situation concerning driving style and/or the traffic situation.

Figure 5:
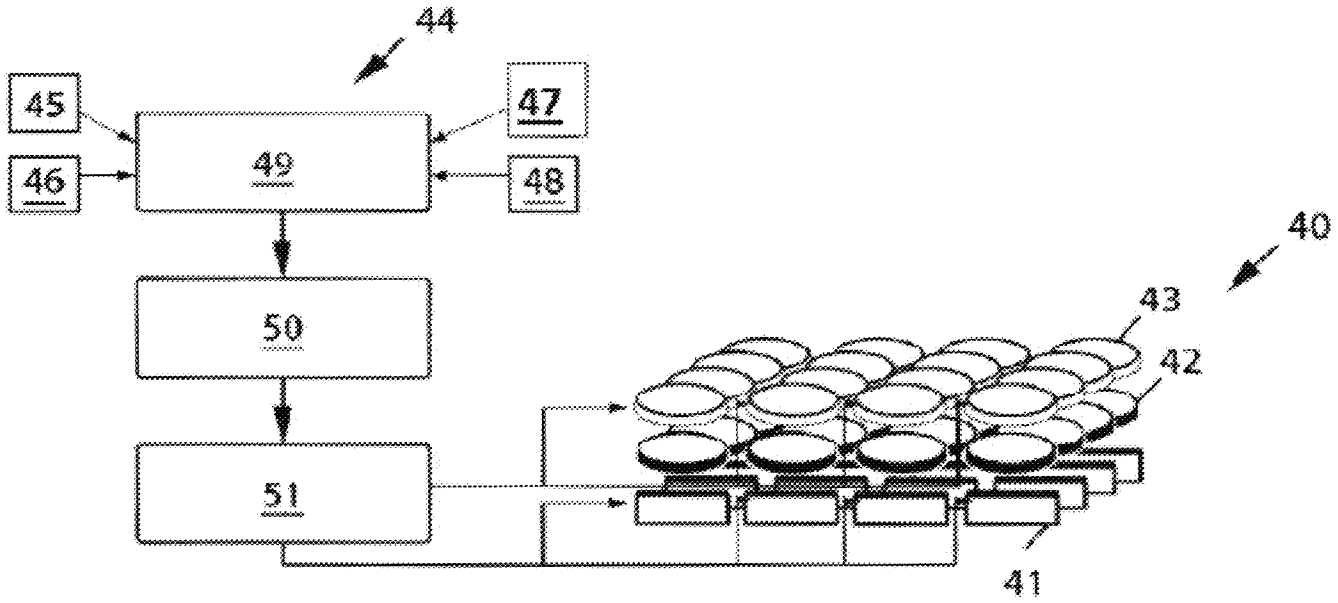
FIG. 5 shows a schematic illustration of a further example of a lighting apparatus.

FIG. 5 shows an alternative lighting apparatus 40 having a matrix arrangement of illuminants 41, primary optical systems 42 associated with each of the latter and liquid lens arrangements 43. The illuminants and the liquid lens arrangements are actuated via control means 44 in order to be able to set the direction of radiation of the individual light distributions of the illuminants and/or the focusing of the individual light distributions of the illuminants and/or the intensity of the individual light distributions of the illuminants. To this end, the control means 44 receives sensor data 45 and/or vehicle data and possibly driver inputs 46 and also possibly a set of light distributions 47 and a computation code 48 for determining the light distributions. In block 49, a decision about the desired light distribution is made within the control means, by the computation for the setpoint data for the actuation of the illuminants being determined in block 50 and the actuation of the illuminants 41 and of the liquid lens arrangements 43 being performed in block 51.

The actuation of the illuminants 41 involves the intensity, angle relative to two planes and two focus values per illuminant 41 being set.

The actuation of the liquid lens arrangement 43 involves the direction of radiation, for example as an angle relative to two planes, and/or the focusing, for example as two focus values per liquid lens arrangement 43, being set. In addition, the intensity of the illuminants 41 can be set using an intensity value.

In another variant embodiment, it is also possible for different control parameters to be selected. The parameters are obtained from an adapted light distribution that is varied from a three-dimensional basic distribution on the basis of selected altered basic parameters and, as a result, can be adjusted to suit the current traffic situation. This adaptive light distribution is then implemented as a setpoint distribution as closely as possible by the headlamp. This is accomplished by adjusting the control parameters.

Figure 7:
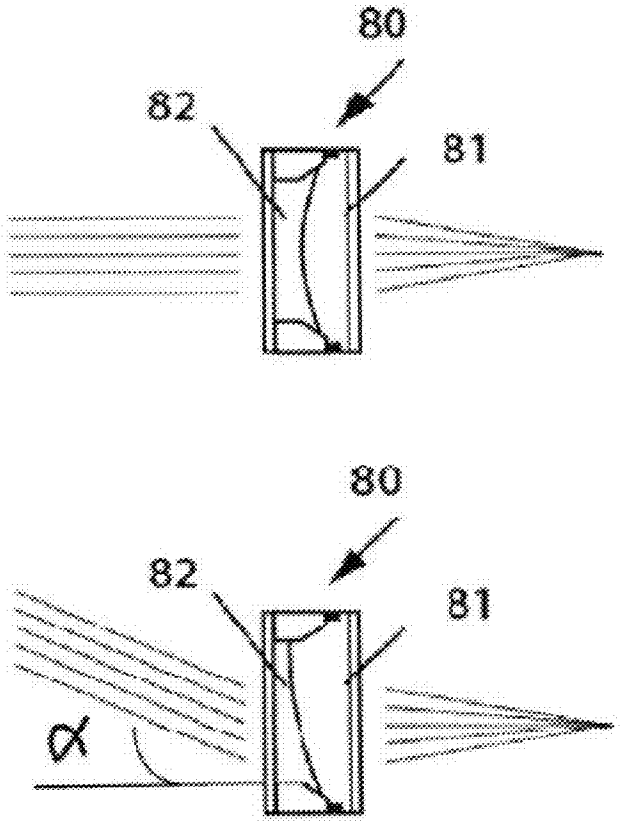
FIG. 7 shows illustrations to explain a liquid lens arrangement.
Figure 6:
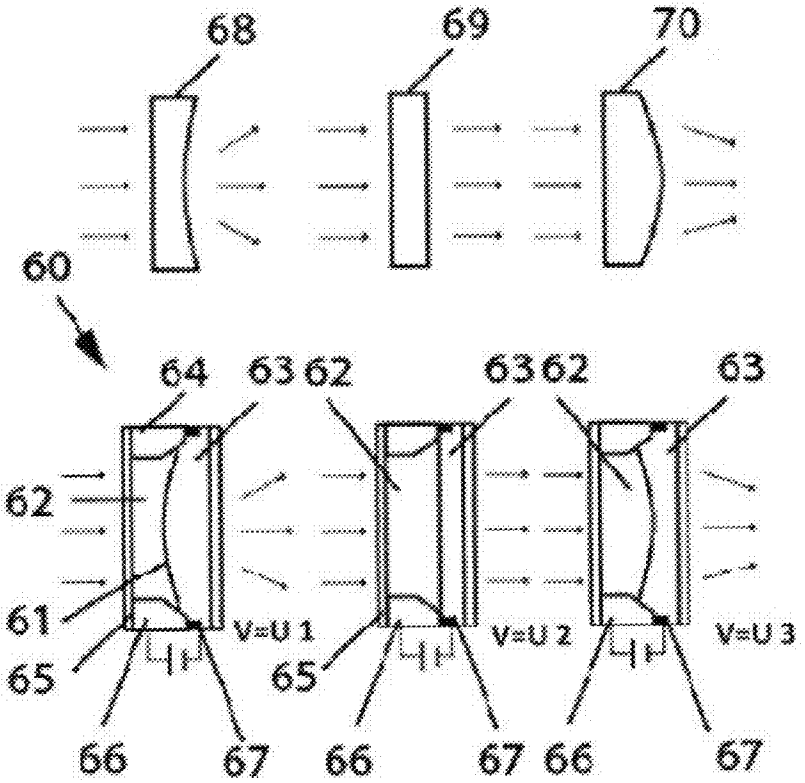
FIG. 6 shows illustrations to explain a liquid lens arrangement.

FIGS. 6 and 7 show a schematic illustration of the operation of liquid lens arrangements. Such a liquid lens arrangement has two fluids 62, 63 that are arranged adjacent to one another in an axial direction, are separated by a flexible wall 61 and have different optical refractive indices. The fluids are arranged in a housing 64 that is typically in the form of an annular housing and that is closed off in the axial direction by optically transmissive plates. The perimeter has electrodes 66, 67 in a distributed arrangement on it in order to produce an electrical voltage between the electrodes in order to control the behavior of the fluids. Thus, in the left-hand part of the image in FIG. 6, a voltage U1 of 30 volts, for example, is applied between the electrodes 66, 67, so that the fluid 62 is in the form of a concave lens, so that the optical equivalent circuit diagram 68 is embodied as a concave lens. In the central region of FIG. 6, a voltage U2 of 45 volts, for example, is applied between the electrodes 66, 67, so that the interface between the fluids 62, 63 is planar, so that a planar lens is produced whose equivalent circuit diagram is in the form of a planar lens 69. Accordingly, increasing the voltage between the plano-convex lens 68 produces the transition to a planar lens 69. If the voltage is increased further, as can be seen in the right-hand part of FIG. 6, in which a voltage U3 of 60 volts, for example, is applied, then a plano-convex lens is produced between the fluids 62, 63, so that the equivalent circuit diagram yields a plano-convex lens 70. Control can also involve the use of other voltage values. By way of example, it is thus also possible, depending on the embodiment of the liquid lens arrangement, for the behavior of the lens to be controlled from a plano-concave lens to a plano-convex lens by reducing the voltage, for example.

It can be seen that simple electrical or electronic actuation of the liquid lens arrangement 60 allows control from a plano-concave lens through to a plano-convex lens. As a result, different focusings can be made possible. If the voltage is then not arranged in a manner evenly distributed over the perimeter, but rather is also modulated over the perimeter, then FIG. 7 also allows the direction of radiation to be controlled.

FIG. 7 reveals a liquid lens arrangement 80, and in the left-hand part of the image the control of the fluids 81, 82 is in a form such that the control is evenly distributed over the perimeter, so that the direction of radiation is not tilted in relation to the liquid lens arrangement in comparison with the vertical directions. In the right-hand part of the image, the actuation of the fluids is modulated in a manner distributed over the perimeter, so that the direction of radiation is tilted by the angle $\alpha$ in comparison with the straight direction. In this case, depending on the actuation of the applied voltage, in a manner distributed over the perimeter, essentially any direction of radiation can be selected.

Figure 8:
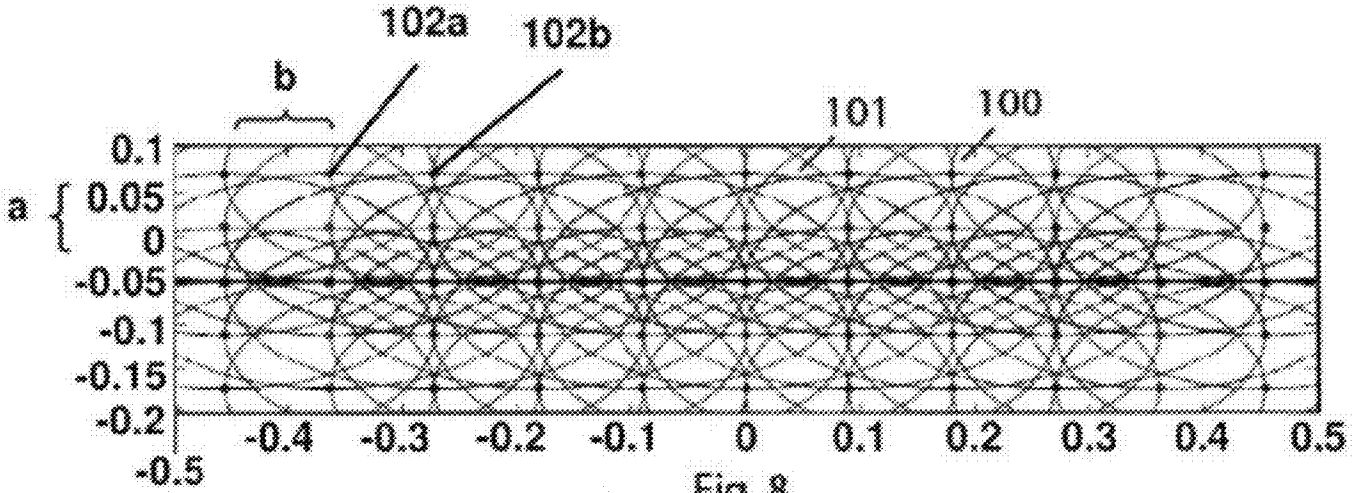
FIG. 8 shows an illustration of an example of an overall light distribution that arises from a superimposition of individual light distributions.

FIG. 8 shows a schematic illustration of an overall light distribution 100 as a superimposition of individual light distributions 101 that are evenly distributed over the area, so that an even overall light distribution results. In this case, all the centers of the light distributions are arranged evenly and, like the centers 102*a* and 102*b*, for example, provided with a vertical distance a and a horizontal distance b in relation to one another. In addition, the expansion of all the light distributions is essentially of the same magnitude, like the expansion 103 of the light distribution with the center 102*b*, for example.

Figure 9:
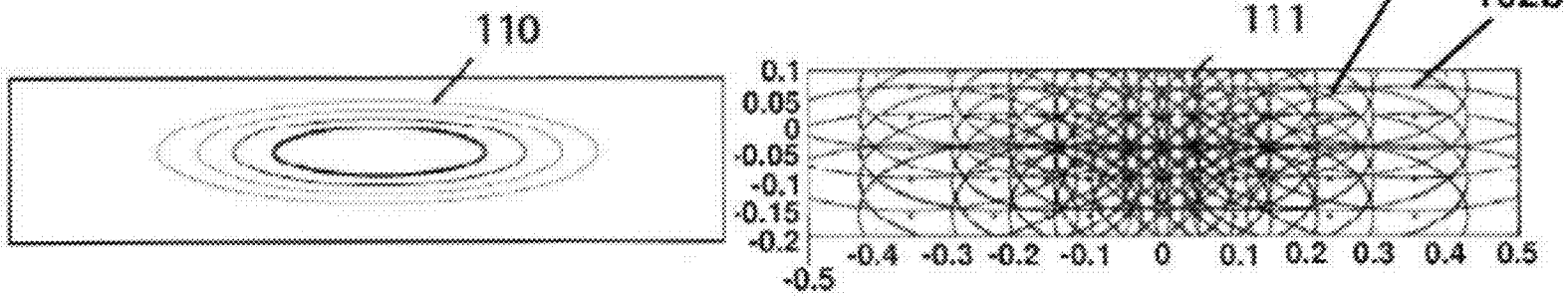
FIG. 9 shows an illustration of a further example of an overall light distribution that arises from a superimposition of individual light distributions.

FIG. 9 shows an overall light distribution 110, see the left-hand illustration, that is again compiled from individual light distributions 111, see the right-hand illustration, with the individual light distributions in the center being more sharply focused essentially in the horizontal direction than at the edge. In addition, the orientation of the individual light distributions 111 is altered such that, in comparison with the arrangement in FIG. 8, they are at a greater distance at the edge, for example represented using the centers 102*a*, than in the center, for example represented using the centers 102*b*, so that the overall light distribution 110 has a higher intensity in the center than at the edge.

Figure 10:
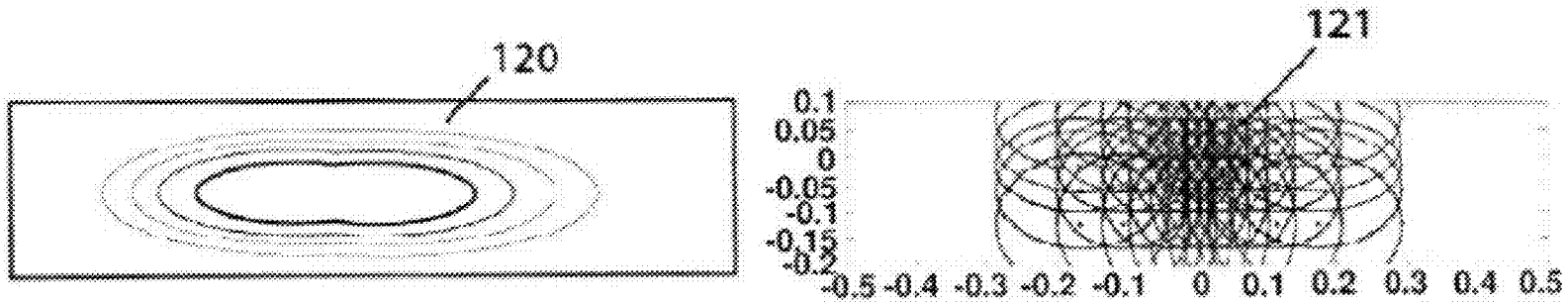
FIG. 10 shows an illustration of a further example of an overall light distribution that arises from a superimposition of individual light distributions.

FIG. 10 shows an overall light distribution 120, see the left-hand illustration, that is again compiled from a multiplicity of individual light distributions 121, see the right-hand illustration, there being sharper focusing for the overall light distribution 120 because the individual light distributions are oriented more strongly toward the center and are focused more sharply essentially in the horizontal direction.

Figure 11:
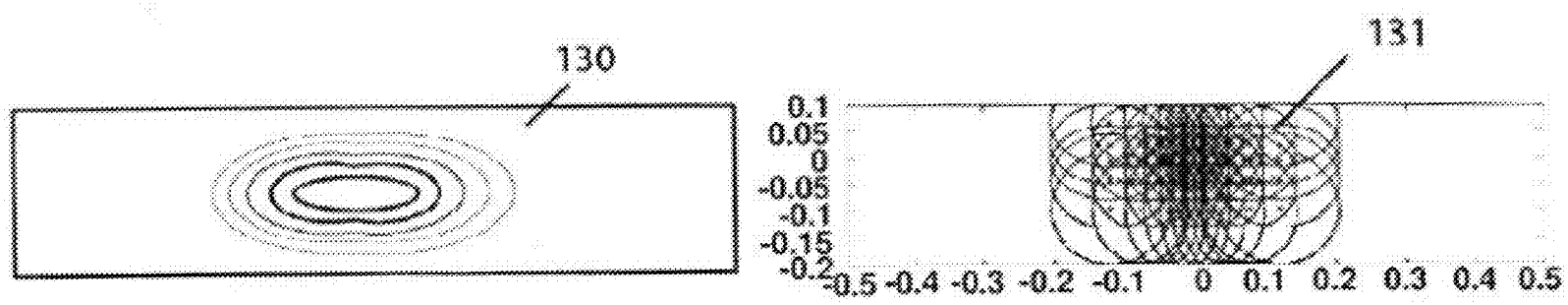
FIG. 11 shows an illustration of a further example of an overall light distribution that arises from a superimposition of individual light distributions.

FIG. 11 again shows an overall light distribution 130, see the left-hand illustration, that is again compiled on the basis of a multiplicity of individual light distributions 131, see the right-hand illustration, with sharp focusing in the center of the overall light distribution being the result.

Figure 12:
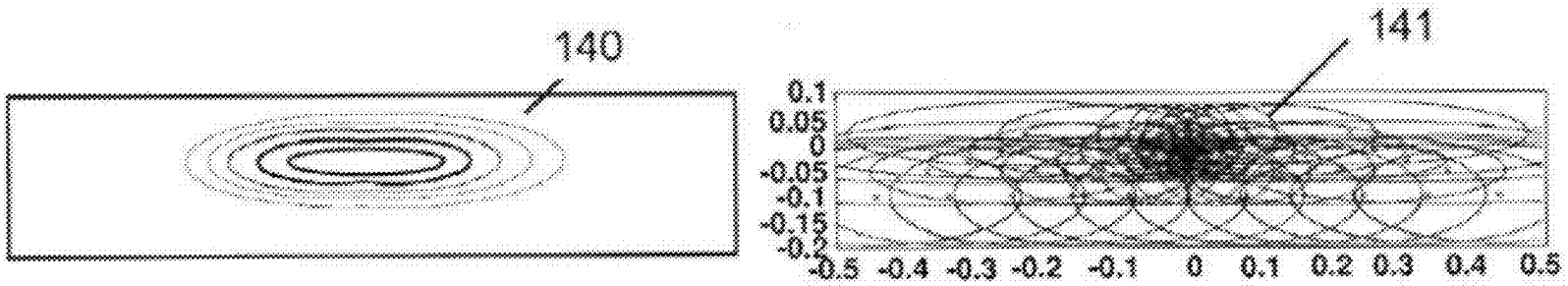
FIG. 12 shows an illustration of a further example of an overall light distribution that arises from a superimposition of individual light distributions.

FIG. 12 again shows an overall light distribution 140, see the left-hand illustration, that results on the basis of a multiplicity of individual light distributions 141, see the right-hand illustration, wherein the overall light distribution represents a light distribution for a high beam from a headlamp.

Figure 13:
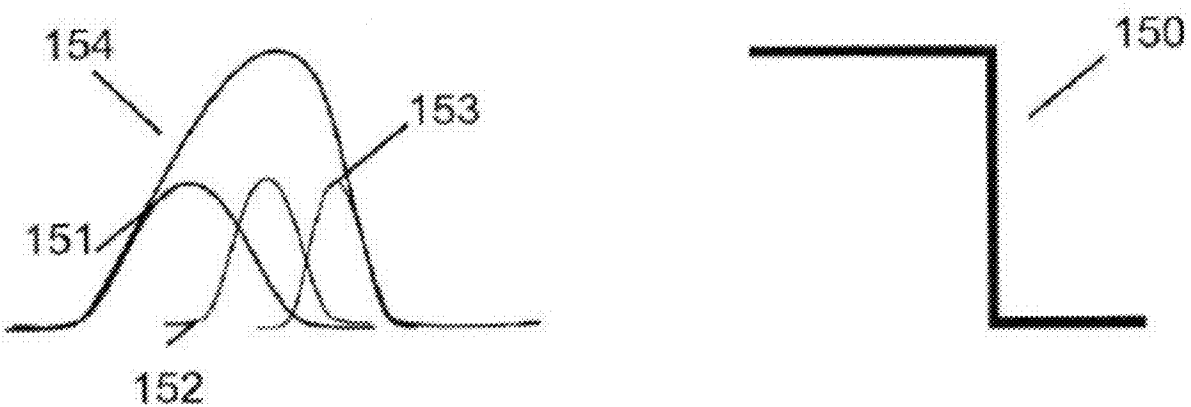
FIG. 13 shows an illustration to explain the production of a bright/dark boundary or an edge in the light distribution.

FIG. 13 shows a schematic illustration of how a bright/dark boundary or an edge, see the right-hand illustration, in which there is a higher intensity of light on the left-hand side than on the right-hand side, results from superimposition of, by way of example, three individual light distributions 151, 152, 153, see the left-hand illustration, to produce an overall light distribution 154, so that an edge in the overall light distribution can arise as a result of suitable choice of the individual light distributions, for example with ever narrower focusing toward the edge. For one edge, it is also possible for more than three light distributions to be superimposed. In this case, the characterization of the edge is dependent on the number of superimposed light distributions. Bright/dark boundaries can be used in the light distribution not just to produce a low beam but rather also to open at least one tunnel having reduced intensity for at least one vehicle ahead and/or oncoming vehicle, in order to avoid dazzling the at least one other vehicle. The tunnels can have their direction, distance and width altered with the movement of the, for example one, oncoming vehicle. In this case, the number of possible tunnels is dependent on the number of available individual light distributions.

Figure 14:
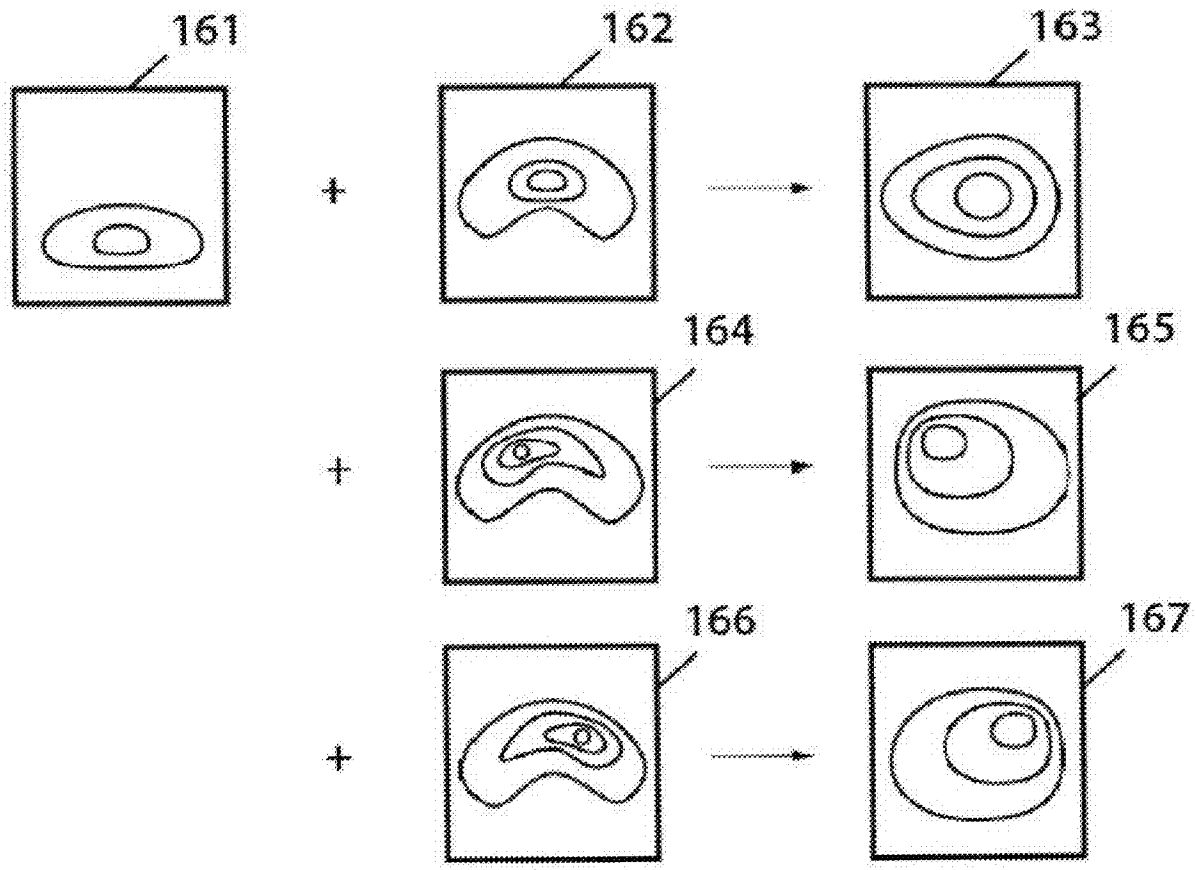
FIG. 14 shows an illustration to explain the production of an overall light distribution from a static basic light distribution and dynamically controllable light distributions.

FIG. 14 shows a schematic exemplary embodiment of a combination of static basic light distributions with dynamic controllable light distributions. In this case, the static basic light distribution 161 is added to a dynamic light distribution 162 to produce an overall light distribution 163. The structure of the basic light distribution, for example as an apron light distribution, is combined with a symmetrical dynamic light distribution 162 to produce an overall light distribution 163 for a straight road profile. Alternatively, the basic light distribution 161 can also have a dynamic light distribution 164 for a left-hand curve added to it, so that an overall light distribution 165 for a left-hand curve is the result. Alternatively, it is also possible for a dynamic light distribution 166 to be added to the basic light distribution 161, so that an overall light distribution 167 for a right-hand curve, for example, is the result.

In this case, the basic light distribution 161 at the dynamic light distributions 162, 164 or 166 are superimposed essentially throughout the solid angle range. Alternatively, the dynamic light distribution can also overlap or be combined with the basic light distribution only in a subrange, or alternatively, it is also possible for the basic light distribution 161 to be arranged in the solid angle range such that there is no resultant three-dimensional or solid-angle-like overlap with the dynamic light distributions 162, 164 or 166.

FIGS. 15 to 20 show exemplary arrangements of illuminants with appropriately arranged optical elements, such as primary optical systems and liquid lens arrangements for individually controlling the individual light distributions to produce an overall light distribution. In this case, the arrangement of the illuminants with their optical elements has provision for a respective matrix arrangement for the illuminants, the exemplary embodiments of FIGS. 15 to 20 containing a respective element that is used to produce a basic light distribution and, furthermore, a multiplicity of elements being provided that are used for producing dynamic light distributions.

Figure 15:
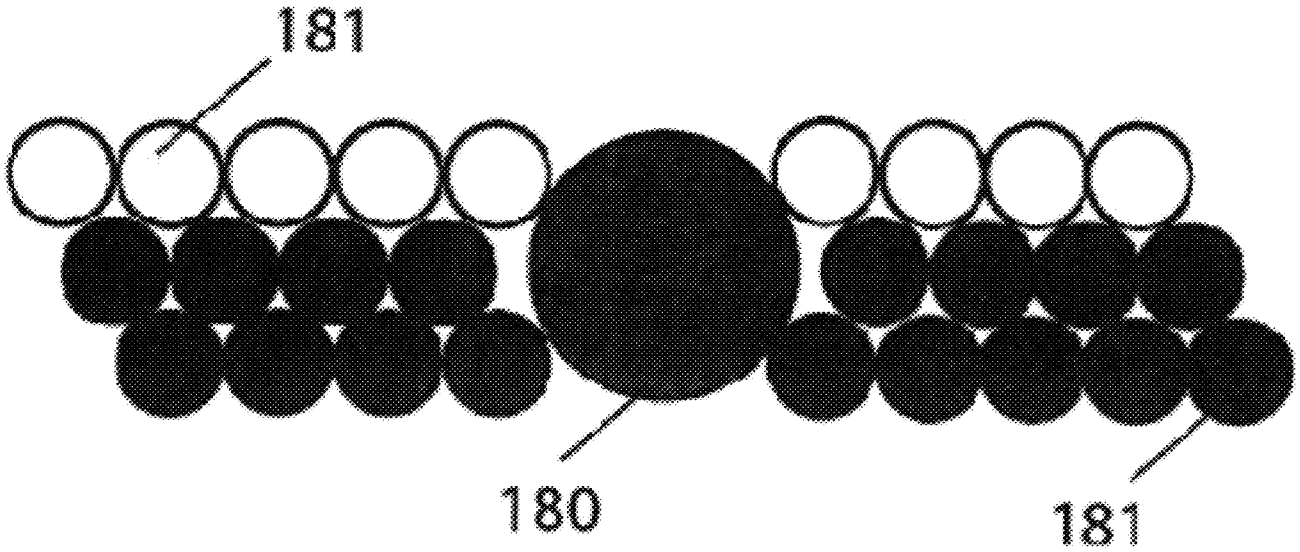
FIG. 15 shows an illustration of an example of an arrangement of illuminants.
Figure 16:
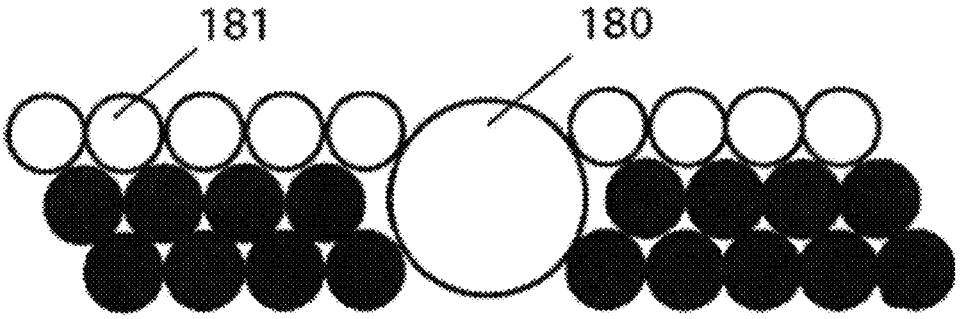
FIG. 16 shows an illustration of a further example of an arrangement of illuminants.
Figure 17:
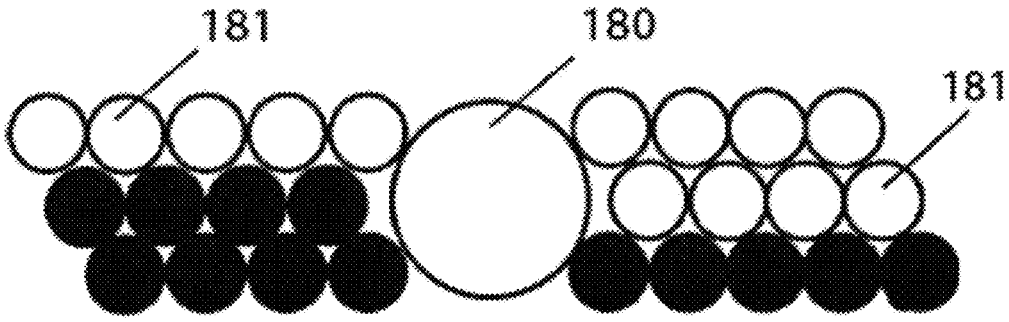
FIG. 17 shows an illustration of a further example of an arrangement of illuminants.
Figure 18:
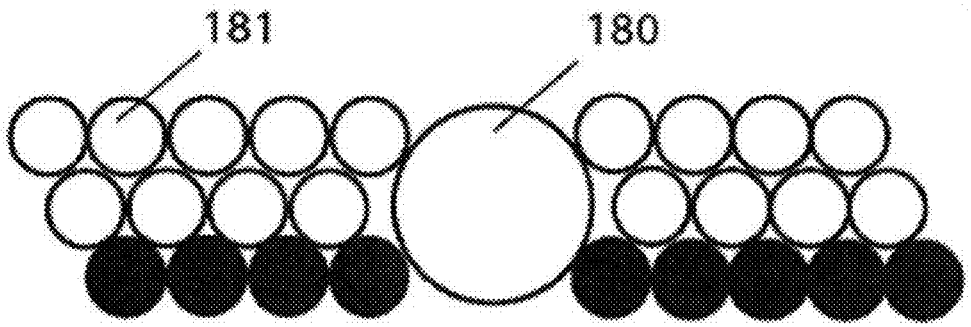
FIG. 18 shows an illustration of a further example of an arrangement of illuminants.
Figure 19:
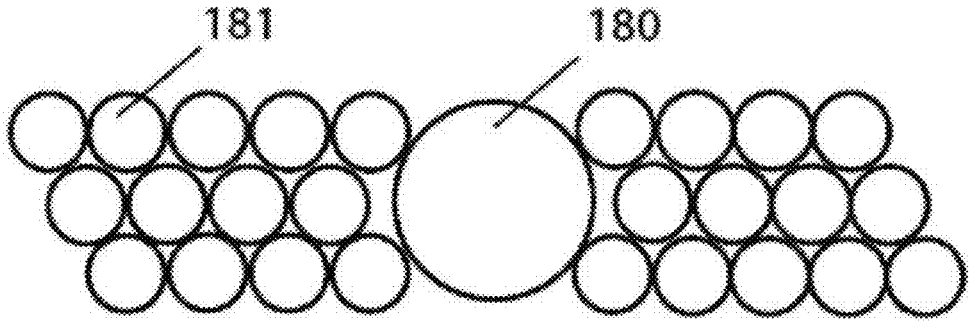
FIG. 19 shows an illustration of a further example of an arrangement of illuminants.

FIG. 15 shows an exemplary embodiment in which an element 180 is arranged centrally, a multiplicity of elements 181 being provided in three rows on both sides of the element 180. The element 180 is used to produce a static basic light distribution for the purpose of undertaking, by way of example, a static apron light distribution, the elements 181 arranged on both sides of the element 180 being used to produce a dynamic light distribution depending on actuation. In the exemplary embodiment of FIG. 15, only the elements 181 in the upper row on both sides of the element 180 are actuated, so that only these elements produce an individual light distribution in order to emit light. By way of example, the result is an overall light distribution for city lights, for example 900 lm. FIG. 16 shows a further exemplary embodiment in which the elements 181 in the topmost row are actuated, and also the element 180 for producing a low beam. The latter may be at 1800 lm, for example. The exemplary embodiment of FIG. 17 shows that the topmost row of the elements 181 and also the right-hand semi-row of the elements 181 and the element 180 are actuated, so that the result is a country road light of 2200 lm, for example. FIG. 18 shows an exemplary embodiment in which the two upper rows of the elements 181 and the element 180 are actuated to produce an overall light distribution, for example for a freeway journey at approximately 2600 lm. FIG. 19 shows an exemplary embodiment in which all of the elements 180 and 181 are actuated to produce the overall light distribution, for example for a high beam at approximately 3500 lm.

Figure 20:
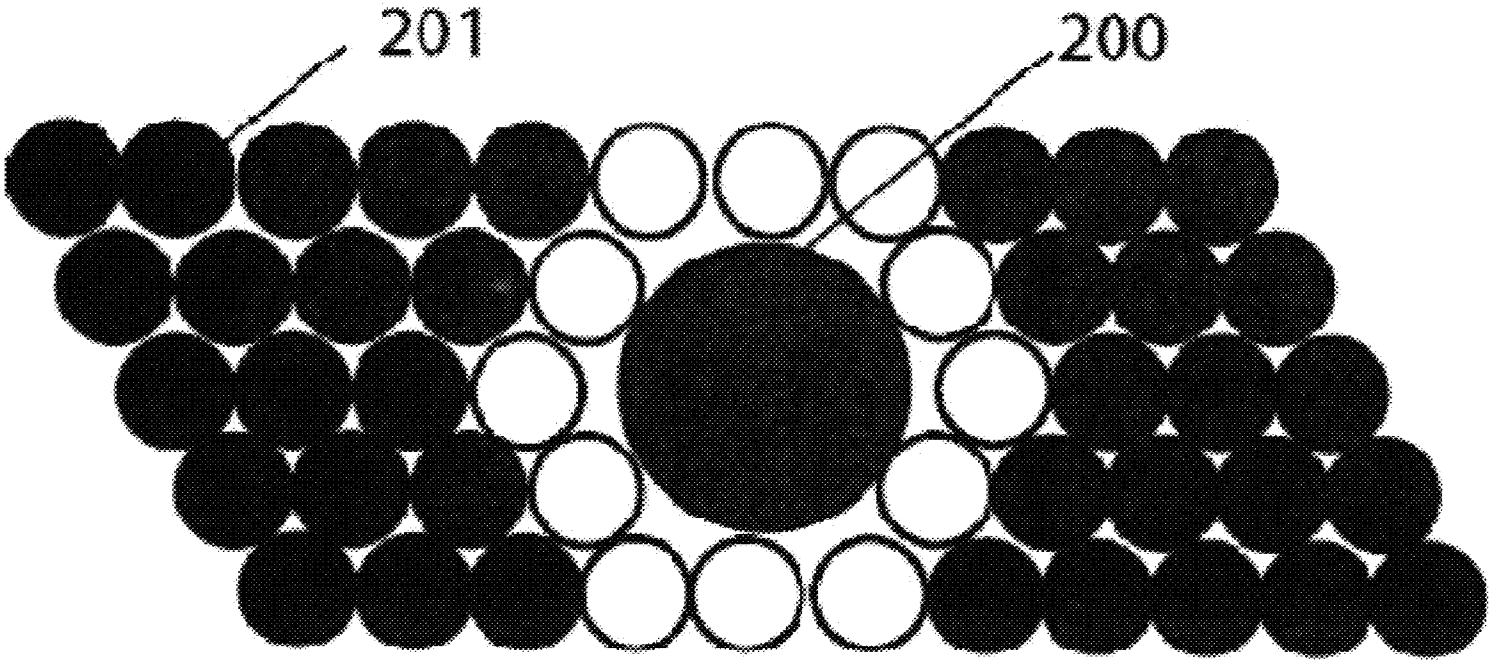
FIG. 20 shows an illustration of a further example of an arrangement of illuminants.

FIG. 20 shows a further exemplary embodiment of the arrangement of an element 200 for producing a basic light distribution and a multiplicity of elements 201, which are arranged in five rows both to the right and to the left of the element 200 and hexagonally around said element, for producing an overall light distribution, depending on the actuation, by superimposing the individual light distribution of the elements 200, 201.

In this case, the element 200 again undertakes a basic light distribution, for example for a static apron distribution, with the elements 201 producing dynamically selectable light distributions that are activable as situation-dependent light distributions.

In the exemplary embodiment of FIG. 20, only the 12 elements 201, which are arranged hexagonally around the element 200, are activated in order to bring about annular activation in order to produce a basic light distribution, for example for city lights or a low beam or daytime running lights.

Figure 21:
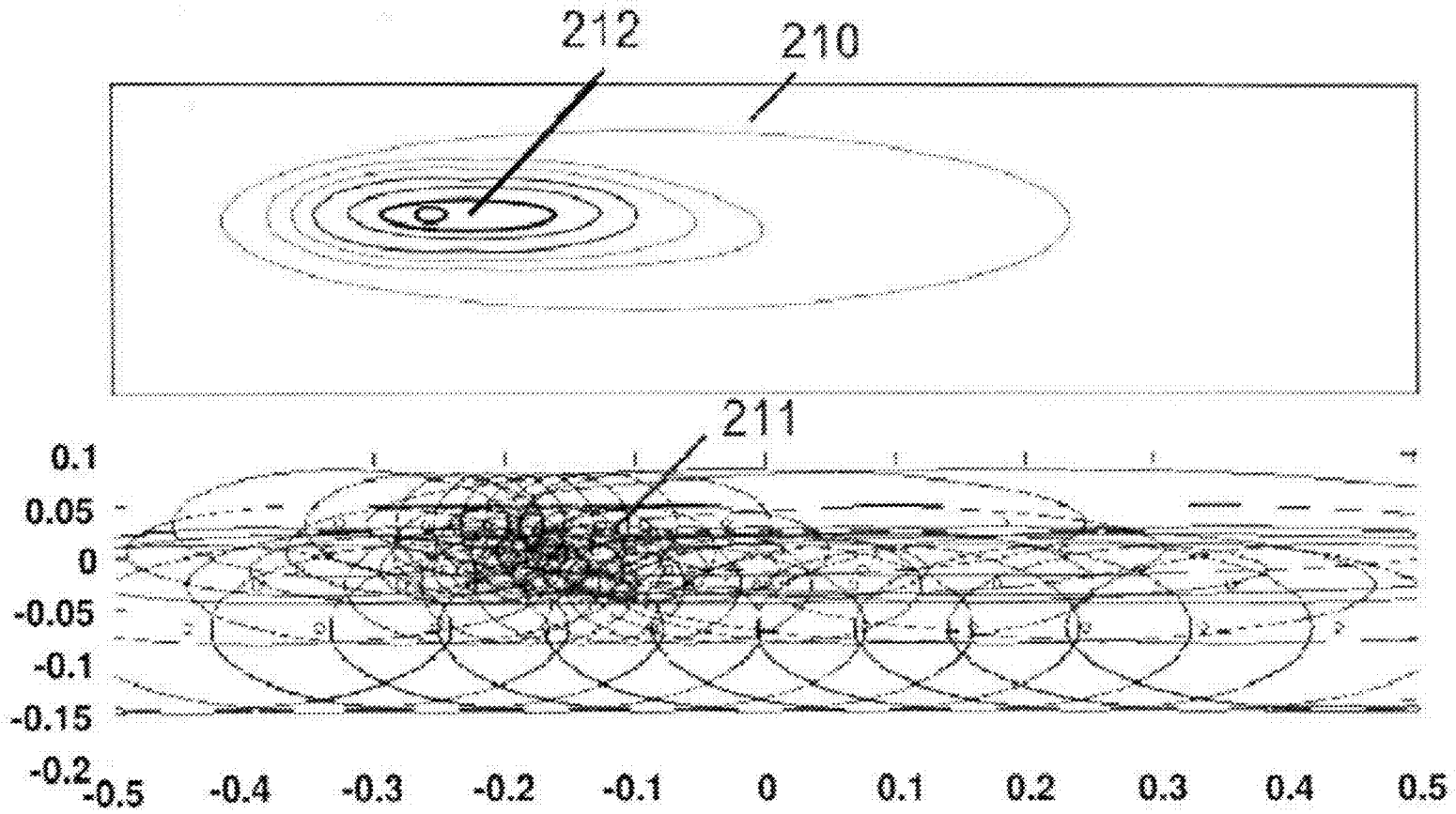
FIG. 21 shows an illustration of a further example of an overall light distribution that arises from a superimposition of individual light distributions.

FIG. 21 again shows an overall light distribution 210, see the left-hand illustration, that results on the basis of a multiplicity of individual light distributions 211, see the right-hand illustration, wherein the overall light distribution is a light distribution for a high beam from a headlamp when cornering with cornering lights. In this case, the overall light distribution in FIG. 21 is modified from the overall light distribution in FIG. 12 such that the bright spot of light 212 is deflected by a defined angle.

LIST OF REFERENCE SYMBOLS

1 Overall light distribution
2 Individual light distribution
3 Illuminant
11 Overall light distribution
12 Individual light distribution
13 Illuminant
20 Lighting apparatus
21 Illuminant
22 Liquid lens element
23 Primary optical element
24 Light distribution
25 Light distribution
26 Individual light distribution
27 Control means
30 Lighting apparatus
31 Illuminant
32 Primary optical system
33 Liquid lens arrangement
34 Control means
40 Lighting apparatus
41 Illuminant
42 Primary optical system
43 Liquid lens arrangement
44 Control means
45 Sensor data
46 Driver input
47 Set of light distributions
48 Computation code
49 Block
50 Block
51 Block
60 Liquid lens arrangement
61 Wall
62 Fluid
63 Fluid
64 Housing
65 Plate
66 Electrode
67 Electrode
68 Equivalent circuit diagram
69 Equivalent circuit diagram
70 Equivalent circuit diagram
80 Liquid lens arrangement
81 Fluid
82 Fluid
100 Overall light distribution
101 Individual light distribution
110 Overall light distribution
111 Individual light distribution
120 Overall light distribution
121 Individual light distribution
130 Overall light distribution
131 Individual light distribution
140 Overall light distribution
141 Individual light distribution
150 Bright/dark boundary
151 Individual light distribution
152 Individual light distribution
153 Individual light distribution
154 Overall light distribution
161 Basic light distribution
162 Dynamic light distribution
163 Overall light distribution
164 Dynamic light distribution
165 Overall light distribution
166 Dynamic light distribution
167 Overall light distribution
180 Element
181 Element
200 Element
201 Element
210 Overall light distribution
211 Individual light distribution
212 Spot of light

The invention claimed is:

1. Lighting apparatus for a motor vehicle having a plurality of illuminants as light sources that each produce an individual light distribution, having means for setting the direction of radiation of the individual light distribution of the illuminants and having means for setting the focusing of the individual light distribution of the illuminants and having control means for controlling the settings of the individual light distributions to produce a superimposed overall light distribution by dint of superimposition of the individual light distributions of at least single illuminants.

2. Lighting apparatus according to claim 1, wherein the illuminants are in a form such that the intensity of the individual light distribution is adjustable, the respective intensity of the individual light distribution of the illuminants being controllable by the control means.

3. Lighting apparatus according to claim 1, wherein the direction of radiation, the focusing or the intensity of the light distribution of the respective illuminant is individually adjustable.

4. Lighting apparatus according to claim 1, wherein the overall light distribution has an actuatable angle-dependent intensity profile or an actuatable angle-dependent intensity gradient profile.

5. Lighting apparatus according to claim 1, wherein the adjustment of the overall light distribution is controlled by dint of activation of the individual light distributions in time steps.

6. Lighting apparatus according to claim 1, wherein the direction of radiation at the individual light distribution is set by dint of adjustment of the lighting direction in respect of two angles, particularly in respect of a pitch angle or a yaw angle.

7. Lighting apparatus according to claim 1, wherein the focusing of the individual light distribution is set by dint of adjustment of the width of the light distribution in the horizontal direction or in the vertical direction or in two other directions that are perpendicular to one another, for example.

8. Lighting apparatus according to claim 1, wherein the image sharpness is adjusted in horizontal and vertical directions together, so that a circular light distribution structure results or is provided separately, so that an elliptical light distribution structure results.

9. Lighting apparatus according to claim 8, wherein the elliptical light distribution structure may be additionally twisted so that an elliptical light distribution structure that is not axially parallel results.

10. Lighting apparatus according to claim 1, wherein the overall light distribution results from superimposition of the individually adjustable individual light distributions from the illuminants, which are essentially all actuatable individually or at least to some extent in groups.

11. Lighting apparatus according to claim 1, wherein the overall light distribution results from superimposition of the individually adjustable individual light distributions of the illuminants, with a static basic light distribution being provided by at least one illuminant and being combinable with dynamically controllable individual light distributions of other illuminants.

12. Lighting apparatus according to claim 11, wherein the static basic light distribution and the individual light distributions are split over different solid angles.

13. Lighting apparatus according to claim 11, wherein the static basic light distribution and the individual light distributions are combined at least to some extent at the same solid angles.

14. Lighting apparatus according to claim 1, wherein the number of illuminants provided is in the range from approximately 10 to 100 illuminants.

15. Lighting apparatus according to claim 1, wherein the luminous element has an associated reflector or an associated projection optical system, the reflector or the projection optical system being adjustable relative to the luminous element, or the luminous element also being adjustable.

16. Lighting apparatus according to claim 15, wherein the luminous element is adjustable with the reflector or with the projection optical system.

17. Lighting apparatus according to claim 15, wherein the adjustability also comprises a swivellability.

18. Lighting apparatus according to claim 1, wherein the luminous element has an associated electrically or electronically controllable liquid lens arrangement that can be used to select the direction of radiation of the individual light distribution of the illuminant and/or the focusing of the individual light distribution of the illuminant.

19. Lighting apparatus according to claim 18, wherein the liquid lens arrangement has an arrangement of two fluids that are arranged adjacently in an axial direction, are separated by a flexible wall and are arranged in an annular housing, the relative shaping of said fluids being alterable by means of electrical actuation.

20. Lighting apparatus according to claim 19, wherein the annular housing has electrodes provided on it for controlling the shaping.

21. Lighting apparatus according to claim 18, wherein the luminous element and the liquid lens arrangement have a primary optical system arranged between them for influencing the light distribution produced by the luminous element.

22. Lighting apparatus according to claim 18, wherein a matrix of luminous elements with a respective associated primary optical system and a liquid lens arrangement is provided.

* * * * *